US010535237B2

(12) United States Patent
Nowzari

(10) Patent No.: US 10,535,237 B2
(45) Date of Patent: Jan. 14, 2020

(54) HOME EMERGENCY ALERT LIGHT SYSTEM

(71) Applicant: Nader Nowzari, Oakville (CA)

(72) Inventor: Nader Nowzari, Oakville (CA)

( * ) Notice: Subject to any disclaimer, the term of this patent is extended or adjusted under 35 U.S.C. 154(b) by 0 days.

(21) Appl. No.: 16/110,047

(22) Filed: Aug. 23, 2018

(65) Prior Publication Data

US 2019/0259255 A1 Aug. 22, 2019

Related U.S. Application Data

(63) Continuation-in-part of application No. 15/448,078, filed on Mar. 2, 2017, now Pat. No. 10,083,597, and a continuation-in-part of application No. 14/756,340, filed on Aug. 31, 2015, now abandoned.

(51) Int. Cl.
*G08B 21/02* (2006.01)
*G08B 7/06* (2006.01)
*G08B 25/10* (2006.01)

(52) U.S. Cl.
CPC ..... *G08B 7/064* (2013.01); *G08B 25/10* (2013.01)

(58) Field of Classification Search
CPC ..... G06Q 10/00; G07C 2009/0065; G07C 9/00309; G07C 9/00896; G08B 25/016; G08B 25/08; G08B 25/10; G08B 7/064; G08B 13/1963; G08B 13/19647; G08B 13/19695; G08B 19/005; G08B 23/00; H04L 63/302; H04L 67/306; E05B 17/0079; E05B 17/0083; E05B 17/0087; E05B 2047/0094; E05B 2047/0095; E05B 45/06; E05B 47/00; E05B 67/00; H04M 2203/355; H04M 3/4217; H04M 3/5116; H04W 4/50; H04W 4/90
USPC ..... 340/539.11, 815.4, 815.45, 691.1, 691.4, 340/539.12, 539.14, 539.26
See application file for complete search history.

(56) References Cited

U.S. PATENT DOCUMENTS

| | | | | |
|---|---|---|---|---|
| 5,025,247 | A | 6/1991 | Banks | |
| 10,083,597 | B2 * | 9/2018 | Nowzari | G08B 7/064 |
| 2003/0093187 | A1 * | 5/2003 | Walker | B64C 13/20 701/1 |
| 2006/0026017 | A1 * | 2/2006 | Walker | G06Q 10/00 701/31.4 |
| 2006/0206246 | A1 * | 9/2006 | Walker | G06Q 10/00 701/16 |
| 2011/0098953 | A1 | 4/2011 | Jonsson | |
| 2012/0314571 | A1 | 12/2012 | Forssell | |

(Continued)

*Primary Examiner* — Daniel Previl
(74) *Attorney, Agent, or Firm* — The H.T. Than Law Group

(57) ABSTRACT

An alert system, for alerting aid responders and to guide them to a residence, and having a bulb having a globe portion containing a plurality of low voltage response lights, a base portion attached to the globe containing a plurality of response circuits and connectable to a domestic conventional power supply and adapted to activate the response lights, fastening means on the base portion whereby it is adapted to be received in a conventional domestic electrical lamp receptacle, and, a radio frequency remote controller adapted to communicate with the response circuits in the base portion operable to activate the low voltage response lights, and a smoke detector having wireless connection with the alert system.

5 Claims, 17 Drawing Sheets

(56) References Cited

U.S. PATENT DOCUMENTS

2013/0293368 A1* 11/2013 Ottah ..... G08B 23/00
340/426.1
2014/0368601 A1* 12/2014 deCharms ..... H04W 4/021
348/14.02

* cited by examiner

HOME EMERGENCY ALERT LIGHT SYSTEM

This application is a Continuation-in-part of application of Ser. No. 15/448,078 filed Mar. 2, 2017, which was a Continuation-in-part of application Ser. No. 14/756,340 filed Aug. 31 2015 title PERSONAL INCIDENT ALERT SYSTEM inventor Nader Nowzari, which was based on U.S. Provisional 62/070,769, filed Sep. 5 2014, title PERSONAL INCIDENT ALERT SYSTEM, the priority of which is claimed.

FIELD OF THE INVENTION

The invention relates to personally installable alert system for alerting responders to an incident in a residence requiring assistance, and in particular, directing responders to the location.

BACKGROUND OF THE INVENTION

Persons who may be handicapped or partly disabled or simply liable to an accident or a health problem of a personal nature, frequently live in private residences. Often they are alone. If and when a personal incident occurs, in such a private residence, it may be some time before aid responders hear of the incident. In addition, where the incident happens in a personal residence, the responders frequently have difficulty in identifying the particular residence. This is a particular problem where they have a street number requiring illumination.

Such a private residence may have several rooms, and floor levels.

A partly disabled or handicapped person or simply the elderly or otherwise infirm, may live alone is such a residence. For example, if such a person has a fall or a sudden health problem, they may be unable to reach a telephone. If they do reach a telephone it may be difficult to communicate with a 911 service, or a responder.

Numerous communication systems have been proposed and some even marketed, for such handicapped, or other persons liable to be subject to such an incident.

However such systems were largely dependent on, for example, remote communication by telephone. In most cases these earlier systems have required installation by a skilled trades person. Often they required maintenance, or regular checking to ensure operability. Monthly charges were usually payable to a monitoring company. All of this has limited the use of such systems to a small segment of society.

In cases of an incident requiring assistance, the responders must identify the address of the resident and then find the residence as quickly as possible. Usually in the case of private residences, there will be a front porch and at least one lighting receptacle. An alert light of some kind, on the front porch would greatly assist first responders looking for a particular residence.

One of the principle obstacles to any such alert or alarm system is that in most cases it would require installation by skilled trades. Alterations would be made to the electrical system in the home, at considerable expense. This expense often put them out of the reach of the very persons, ie the handicapped or elderly persons, who had the greatest need for them.

Most homes have an porch exterior light, on the front, near the front door.

Normally the homeowner would switch this porch light on only when a visitor was expected. Otherwise it was switched off in most cases. Ideally any alert light system will make use of the existing porch light fittings, so as to avoid the need for a tradesman. However if the porch light incandescent bulb was simply replaced by some form of remotely activated alert light bulb, then the porch light was no longer available for lighting the front door for visitors. If the alert light system requires main voltage power, then the porch light switch would have to left on day and night. It is therefore desirable to provide a personally installable alert light system which can be used in conjunction with the existing porch light fixture on the front of the house, and which provides both for the optional switching on or off of the porch light, and also provides for supplying power day and night to the alert light system.

In a preferred case the switching on or off of the porch light effect will be automatic, responding to a photo sensor in the alert light.

Such a system should preferably be available for personal installation, by the resident or a relative, without the need for professional help.

If possible such a system would also provide for communication to first responders, such as fire services, paramedics and possibly police, or even relatives.

All of this should be available as a kit, ready to be personally installed by the purchaser, or a relative, without professional help.

Where possible the system will also provide for a signal to be sent to the responders giving the GPS co-ordinates of the residence. This will still further facilitate the directions to the responders and bring aid quickly to the resident. This can be sent via satellite signals. The system should also desirably provide a remotely operable door lock. In this way the signal from the remote, which activates the alert light, and which alerts the location to responders, will also open the lock. In this way the responders can enter the residence without the need for damaging the door.

Ideally it should be operable without reliance on an outside monitoring service, and payment of monthly fees.

Other forms of emergency in a residence can also be a danger to a resident, or a danger to others. Such emergencies include a fire, whether the resident is present or not, and also possibly flood due to burst pipes. Preferably, the home emergency light system will also respond to such hazards as fires, flooding and the like, whether the resident is there or not. Such emergency warning systems will greatly assist responders, or even neighbours, in dealing with the emergency.

BRIEF SUMMARY OF THE INVENTION

The invention provides a personally installable alert signalling system which when activated can direct aid responders to the residence quickly. In particular the invention provides such a personally installable signalling device in the form of an electrical alert light bulb, which is capable of fitting into a conventional electrical socket on the exterior of the residence and being powered by the regular electrical power system in the residence through a driver circuit and switches, and a remote activator carried by the resident operable to activate the alert light from within the residence in the event of a personal incident to guide responders to that residence, and a smoke detector having wireless connection with the alert system operable even when the residence is unoccupied.

Preferably, such an alert light bulb will incorporate circuitry which will enable the bulb to provide a flashing alert signal. It will also enable the bulb to be used for regular illumination of the porch, by means of a steady light, and will enable such a steady light to be turned on, or off, by the resident according to their wishes or automatically. The circuitry in the bulb will respond to remote wireless signals, from the remote personal activation device, which may be attached to the resident.

In a preferred case the switching on or off of the porch light effect will be automatic, responding to a photo sensor in the alert light.

The entire personally installable system may incorporate a master unit within the residence to be connected to a domestic telephone line system already in the residence, and operable to enable the resident to communicate with aid responders.

The alert flashing circuitry is incorporated in the alert bulb itself. This greatly simplifies personal installation and use by the resident. All that is required is for the resident to buy the alert bulb with the circuits incorporated in it, and to buy a remote control which is capable of communicating with the circuitry within the alert bulb. In this way, it is not necessary for the resident to change the wiring or voltage in the residence, or to install any special antenna or communication wiring in the residence. The remote device carried by the resident will communicate directly with the circuitry in the alert bulb, using radio frequencies, in a remote manner.

Preferably the remote alert circuits will activate an audible alarm, as well as a visual alert light alarm signal.

The entire system may include a personally installable master unit for connecting with a regular phone line, or with a cellular phone connection, and which may also be connected through the internet. Such communication could also include relatives of the resident. It should also provide for two way voice connection ie, a microphone/receiver in the remote to the standard telephone line.

In a further advantageous feature, the base unit may also incorporate a wireless transmission means, for transmitting a signal to a GPS satellite.

Alternatively, the wireless transmission means may communicate via cellular signalling towers.

In a further modification the alert signalling bulb itself may be provided with a battery operation, so that it does not require to be connected to a household circuit. The battery may be a typical dry storage alkaline or rechargeable battery, or may be a solar powered battery, accumulating solar energy on a daily basis as required.

In a still further modification the alert light system may be incorporated in a typical illuminated house street number, so that upon activation by the wireless remote, the illumination of the house street number starts to flash on and off. Furthermore such a house street number system may also incorporate a solar battery storage.

Also as an added feature connection with a smoke alarm in the residence will be an added safety feature. The system can also provide a remotely activated door lock, which will respond to an alert signal to unlock the door of the residence.

In a residence with multiple rooms or multiple floors, it is also desirable that a smoke alarm in one area shall be capable of alerting residents in all areas of the residence. Accordingly, it is desirable that there be several smoke alarms, and they will all be interconnected by radio signals, with each other. In addition, it is an advantage, if the smoke alarm wireless system can also interact with the remote alarm system. In this way, if there is a smoke alarm activated within the residence, it will both activate the other smoke alarms within the residence, so all residents are alerted right away, but in addition it will interact with the remote emergency signalling system, signalling to responders that there is smoke alarm in that residence.

Preferably, such a system will send out emergency signals to the responders even when the residence is unoccupied.

It may also be desirable to provide for alarm responsive units placed in neighbouring homes. These additional alarm units would respond to an alarm in the one residence, and alert the persons in the adjacent homes.

The various features of novelty which characterize the invention are pointed out with more particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

IN THE DRAWINGS

Figure 8A:
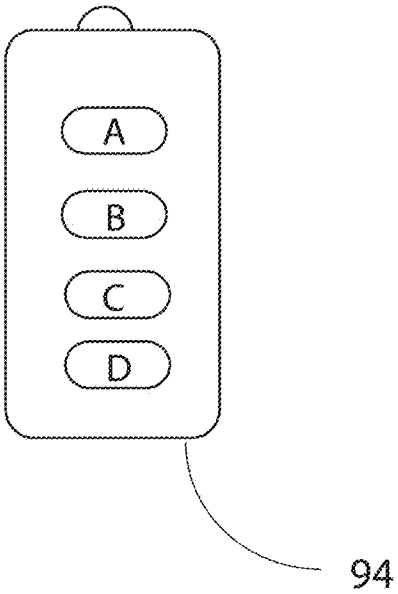
FIG. 8 shows a remotely operated door lock.
Figure 9:
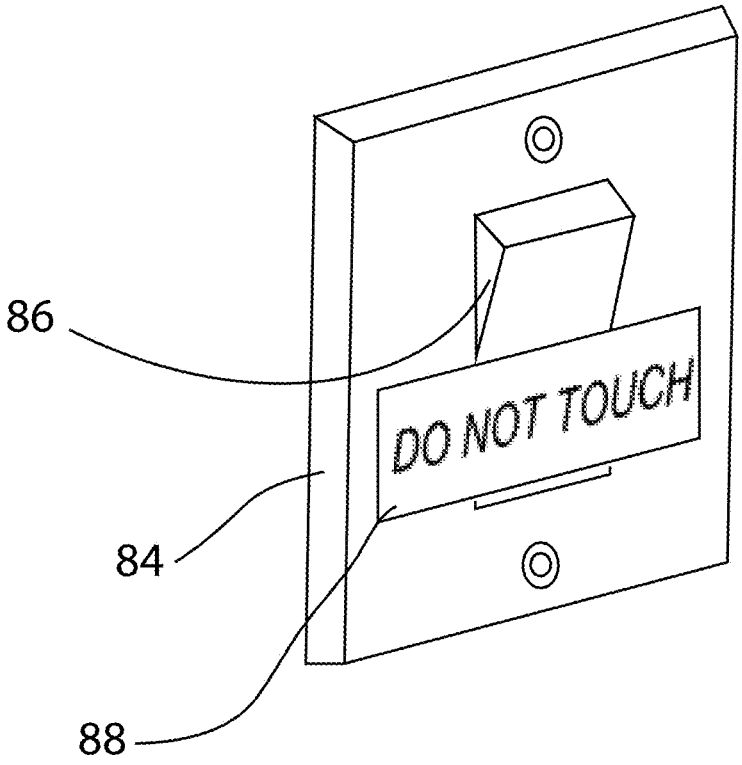
Figure 10:
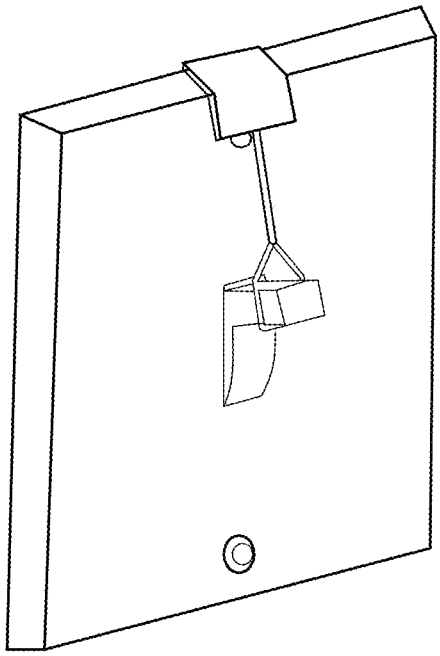
Figure 11:
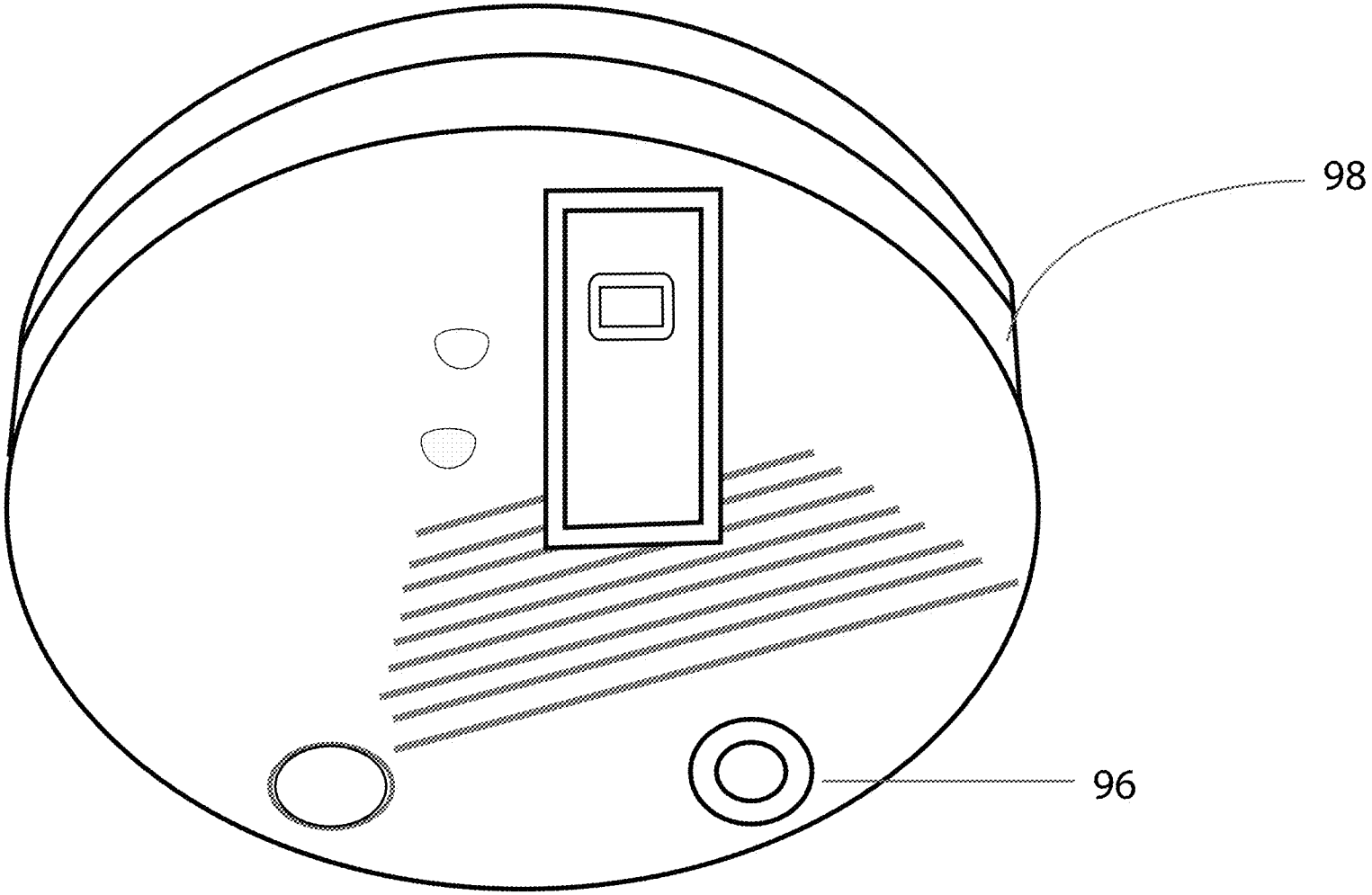
Figure 12:
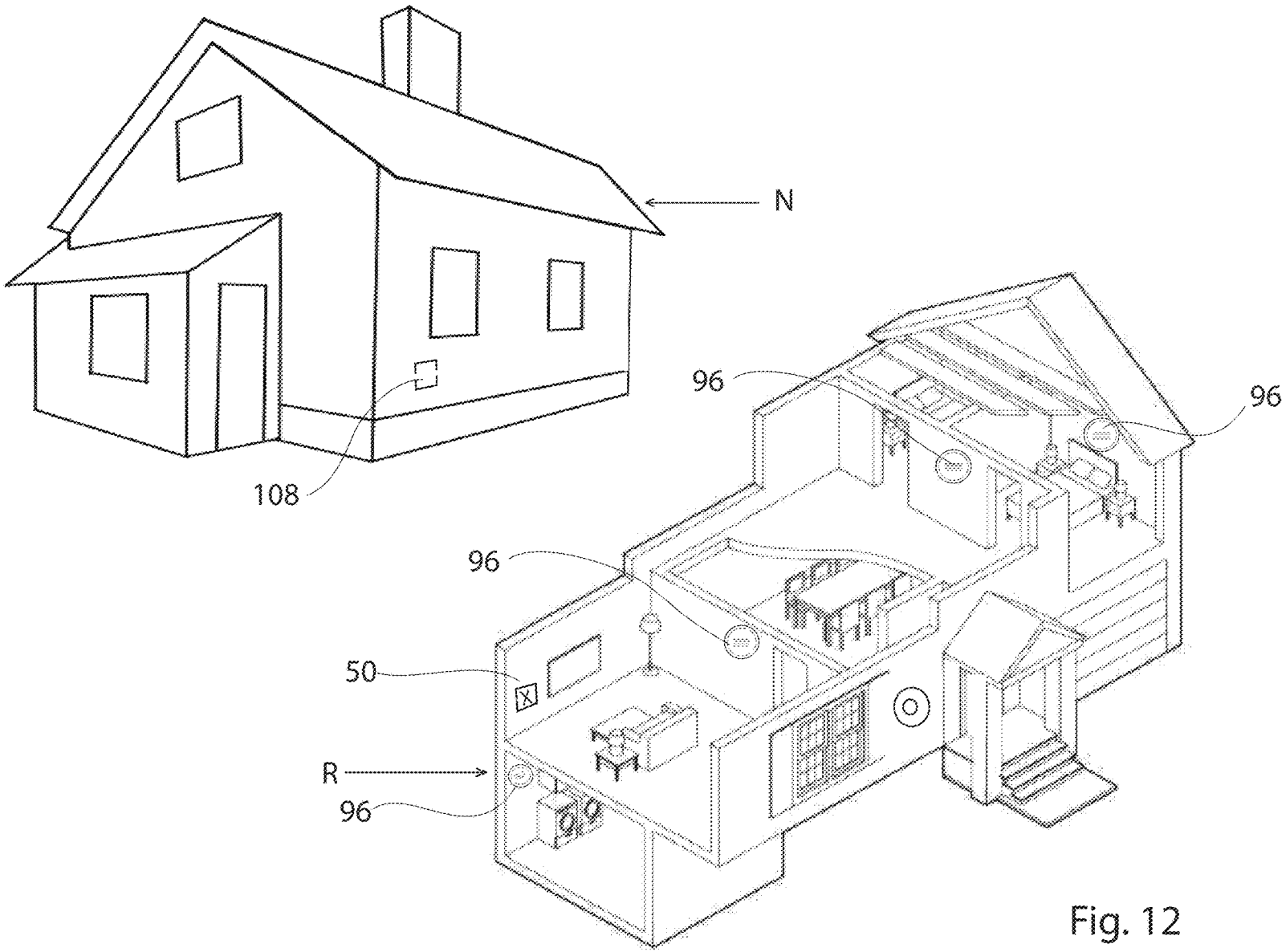
Figure 13:
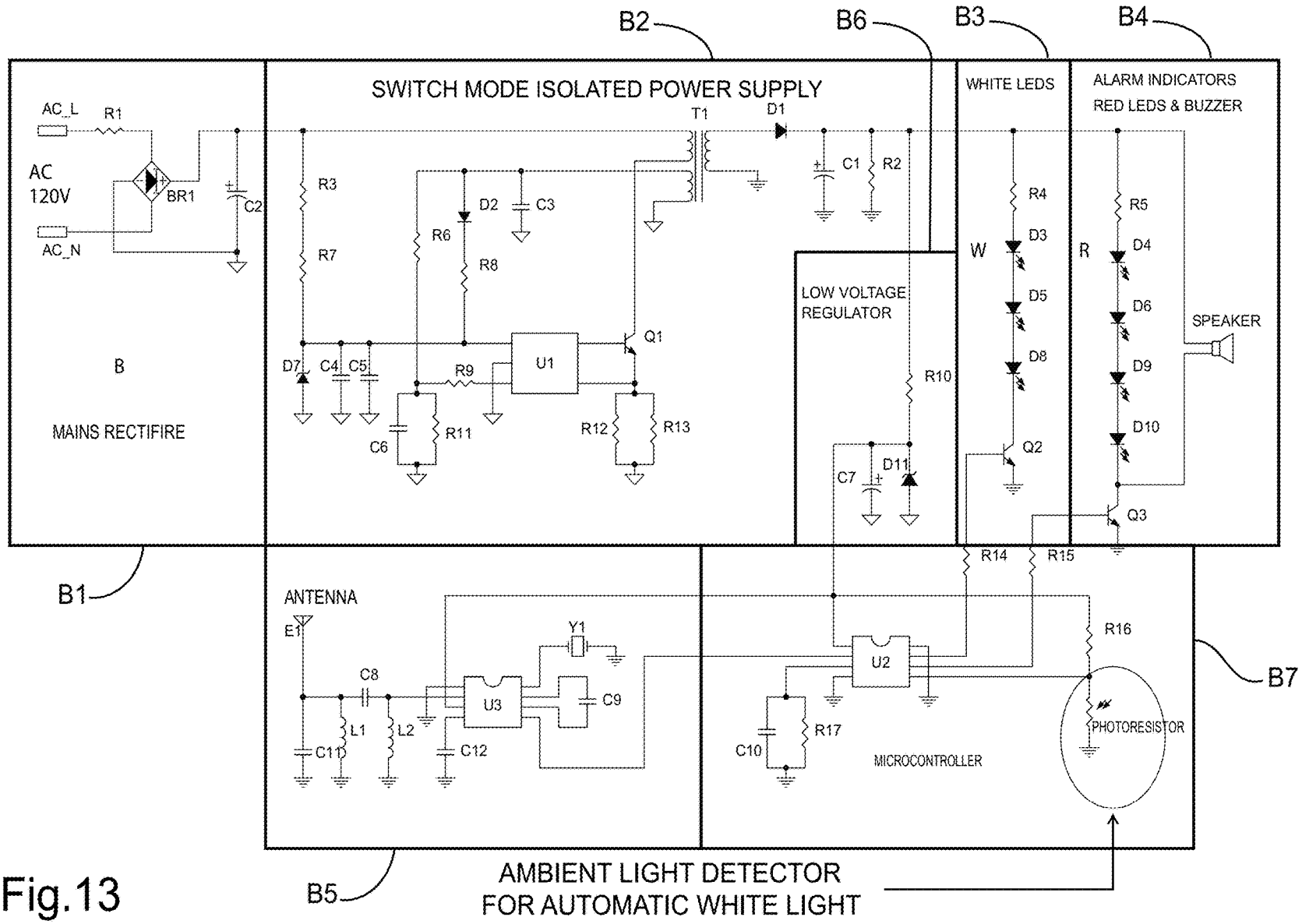
Figure 14:
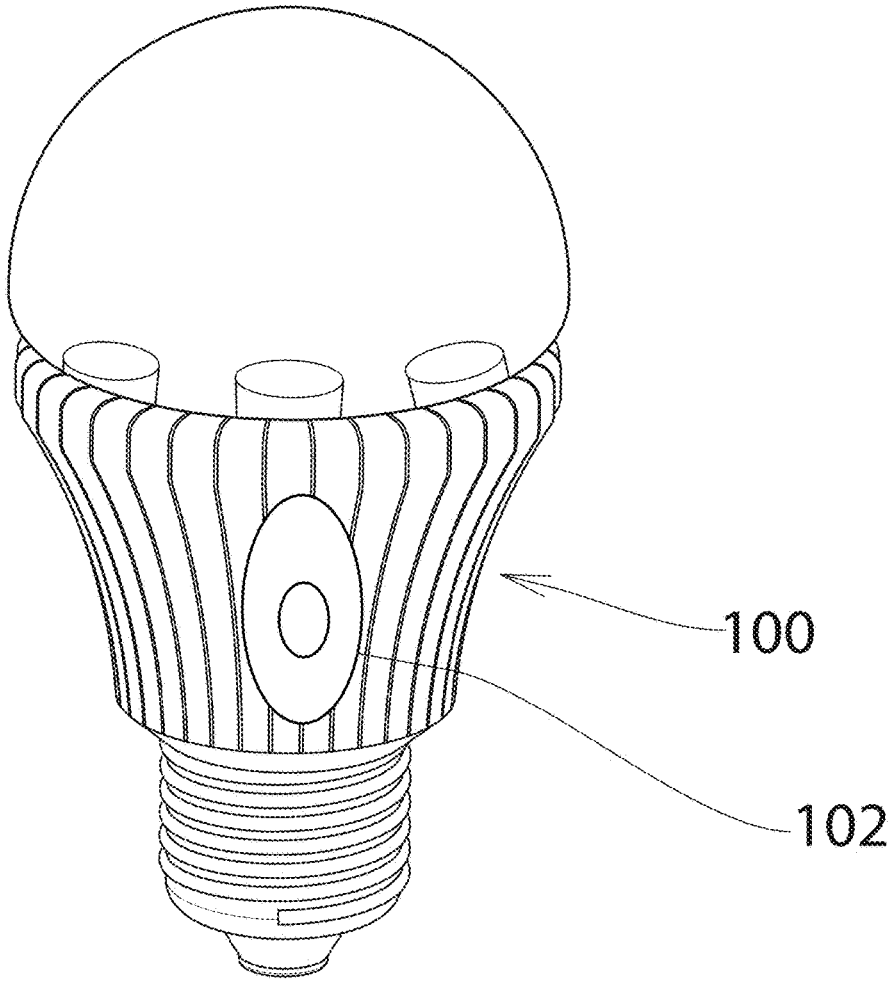
Figure 15:
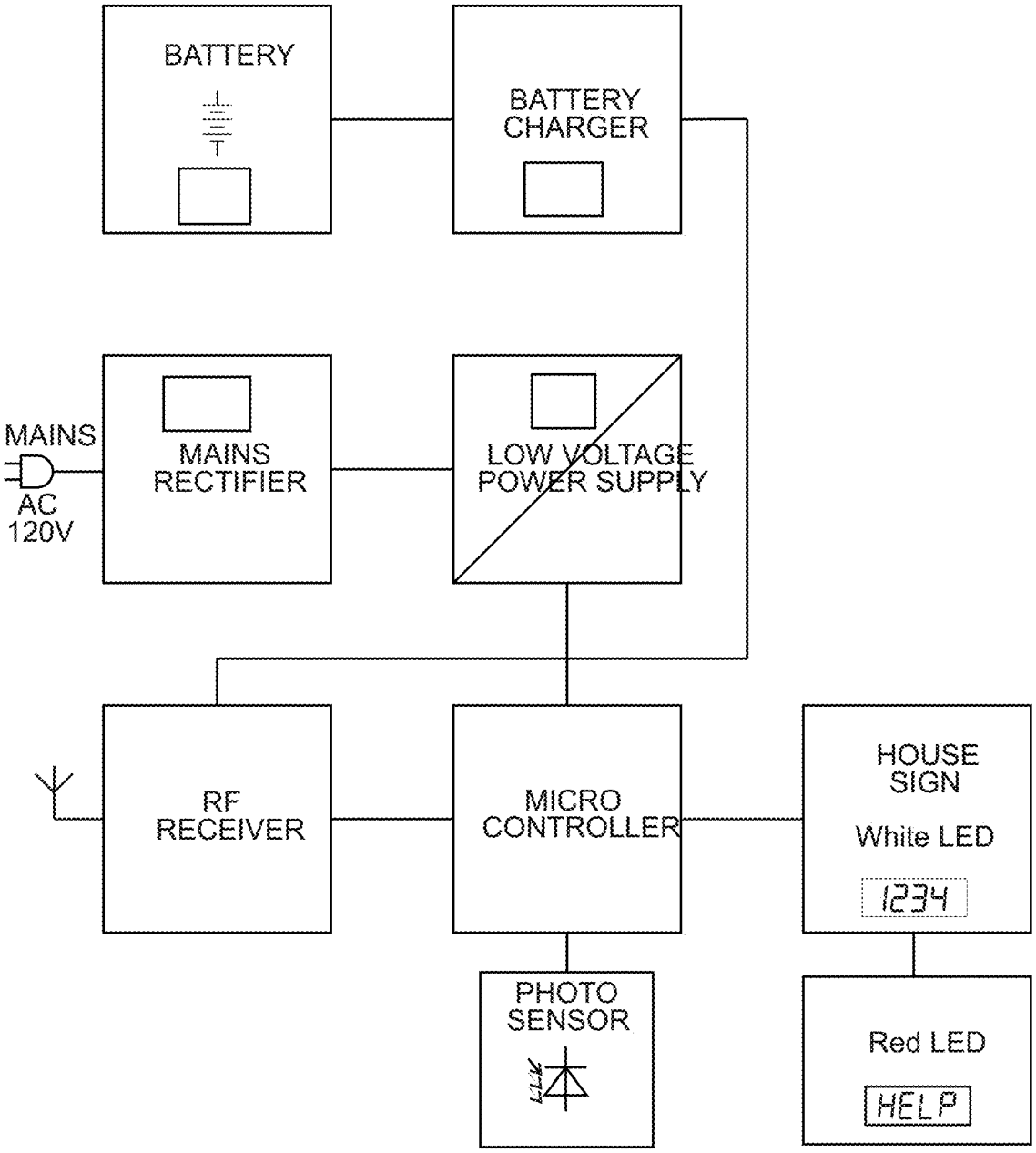
Figure 16:
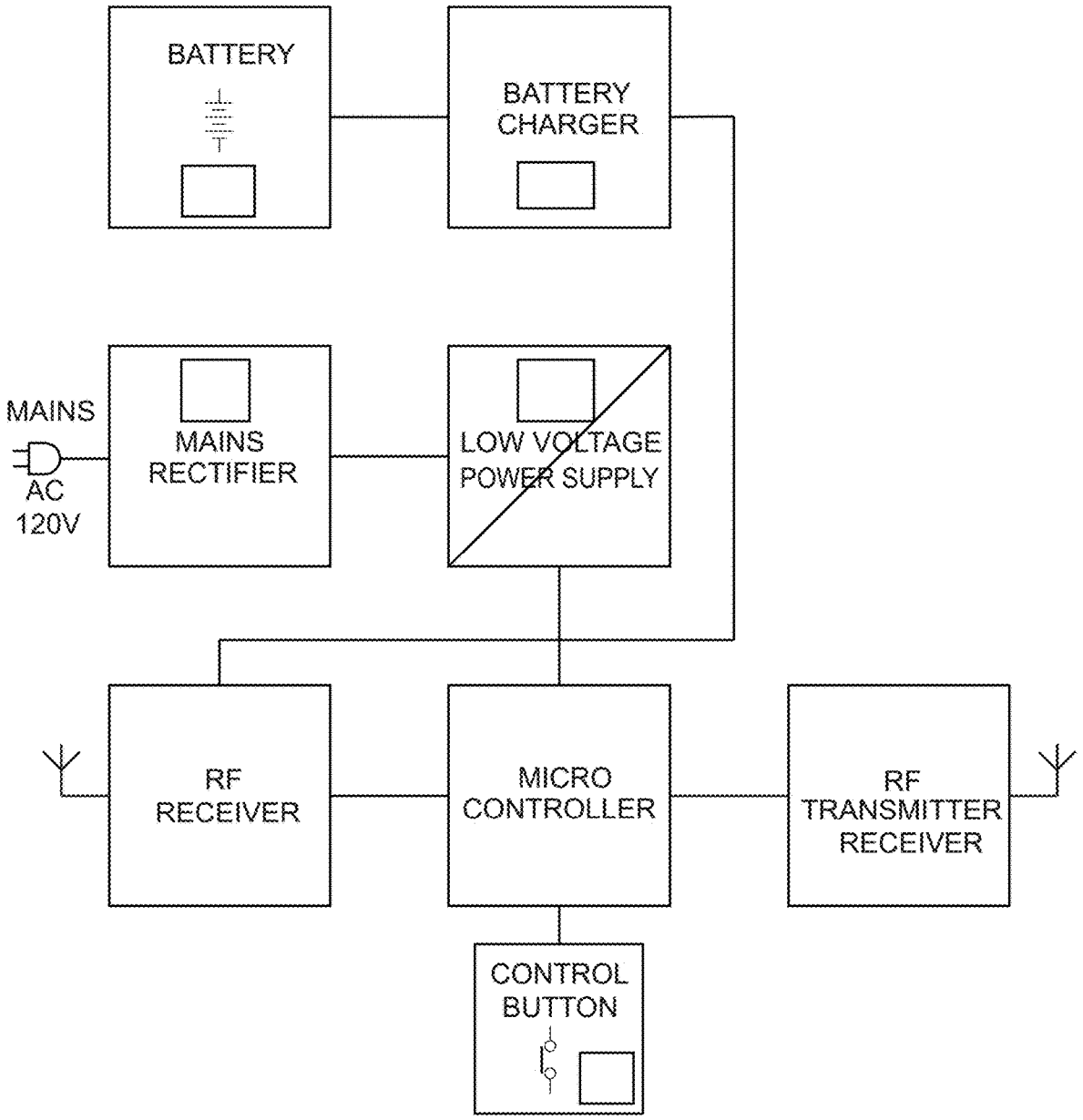
Figure 17:
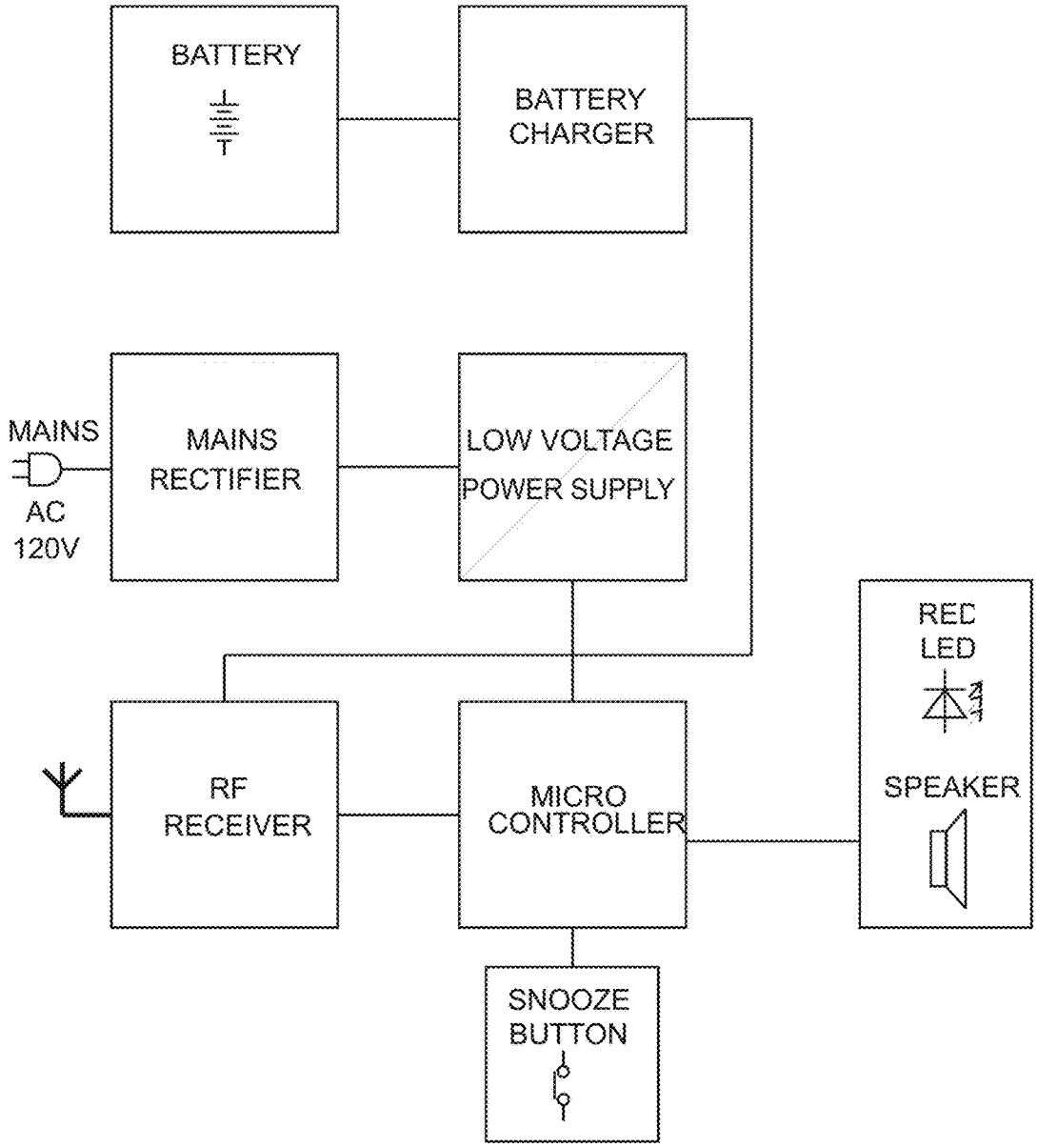
Figure 18:
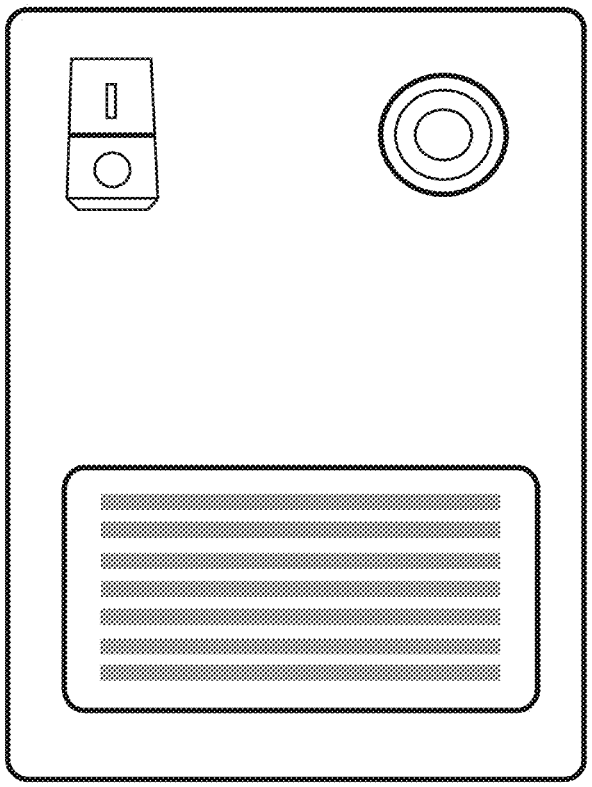
Figure 19:
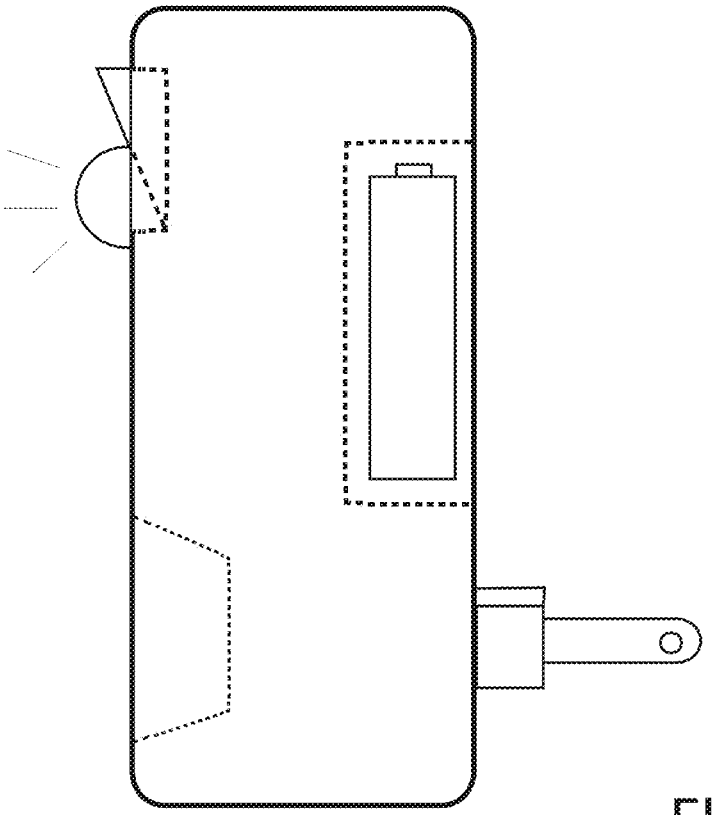

FIG. 8*a* shows a remote for the door lock;

FIG. 9 an FIG. 10 are schematic perspectives showing alternate forms of control for a typical wall switch;

FIG. 11 shows a smoke detector according to the invention modified to incorporate a wireless responsive switch;

FIG. 12 shows a schematic exploded view of the residence, incorporating both smoke detectors, and alert lights, and also showing a radio operated alert signal in a neighbouring residence as well, according to the invention;

FIG. 13 shows a circuit diagram for an alternate embodiment of the invention for activating the alert bulb in either a steady light mode or a flashing mode;

FIG. 14 shows an alternate embodiment of the alert flashing light incorporating a photo electric light sensing cell;

FIG. 15 shows the circuit for the guide light house sign alert, where the house sign is being used in place of the alert bulb;

FIG. 16 shows the circuit diagram for the guide light door lock activator;

FIG. 17 shows the circuit diagram for the neighbour alert signal;

FIGS. 18 and 19 show the neighbour speaker alert.

DESCRIPTION OF A SPECIFIC EMBODIMENT

The invention end product will enable a home owner to place an alert flashing bulb in an exterior socket such as a porch light (10), on the exterior, typically adjacent to the front door of the residence (R.)

The light socket typically is supplied with the normal residential voltage, in North America being around 110 volts. The light socket is of the conventional socket design, of the screw threaded type, designed to receive a typical regular domestic light bulb.

Figure 1:
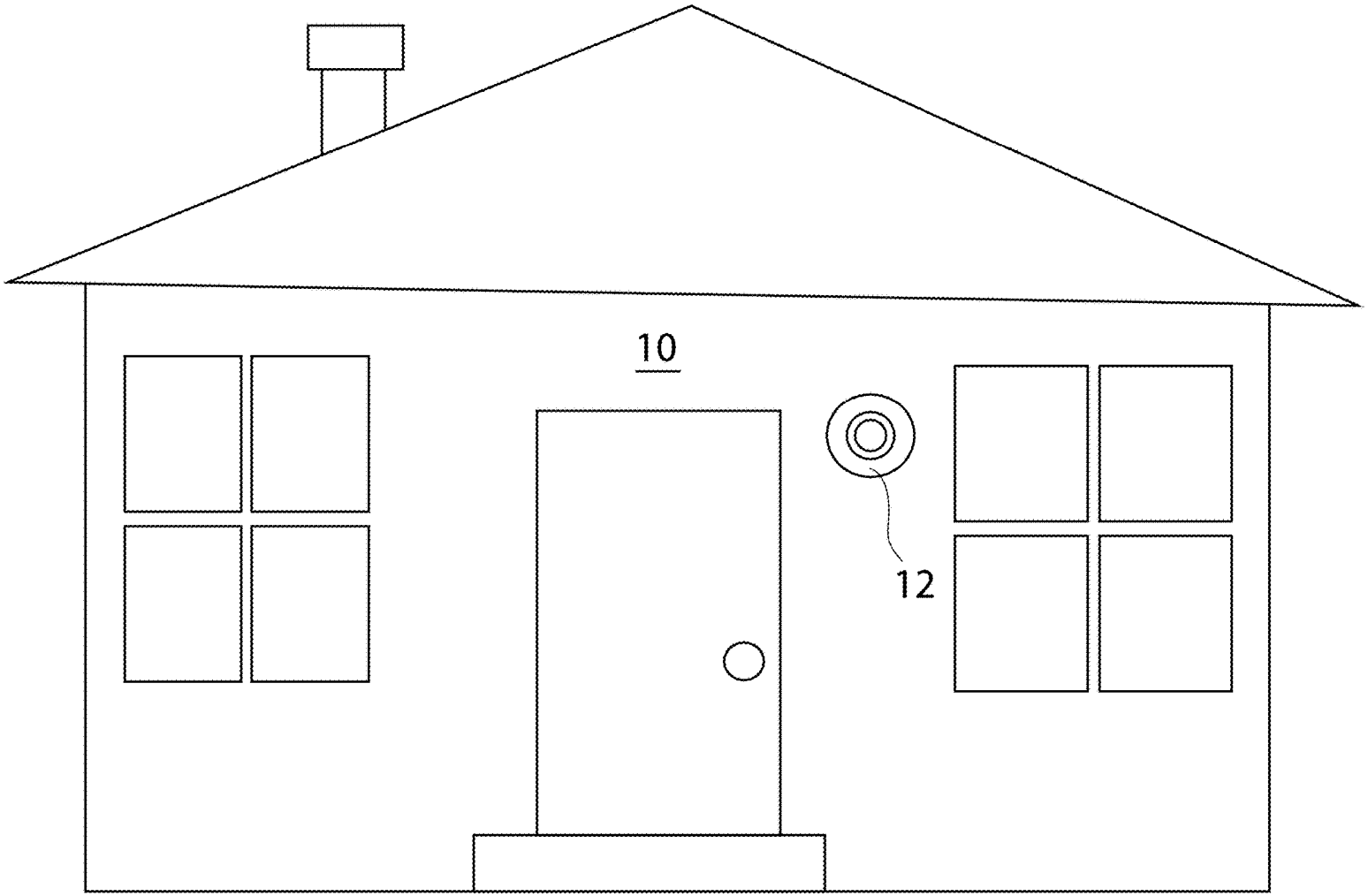
FIG. 1 is a schematic perspective illustration showing a typical residence on a street.
Figure 2:
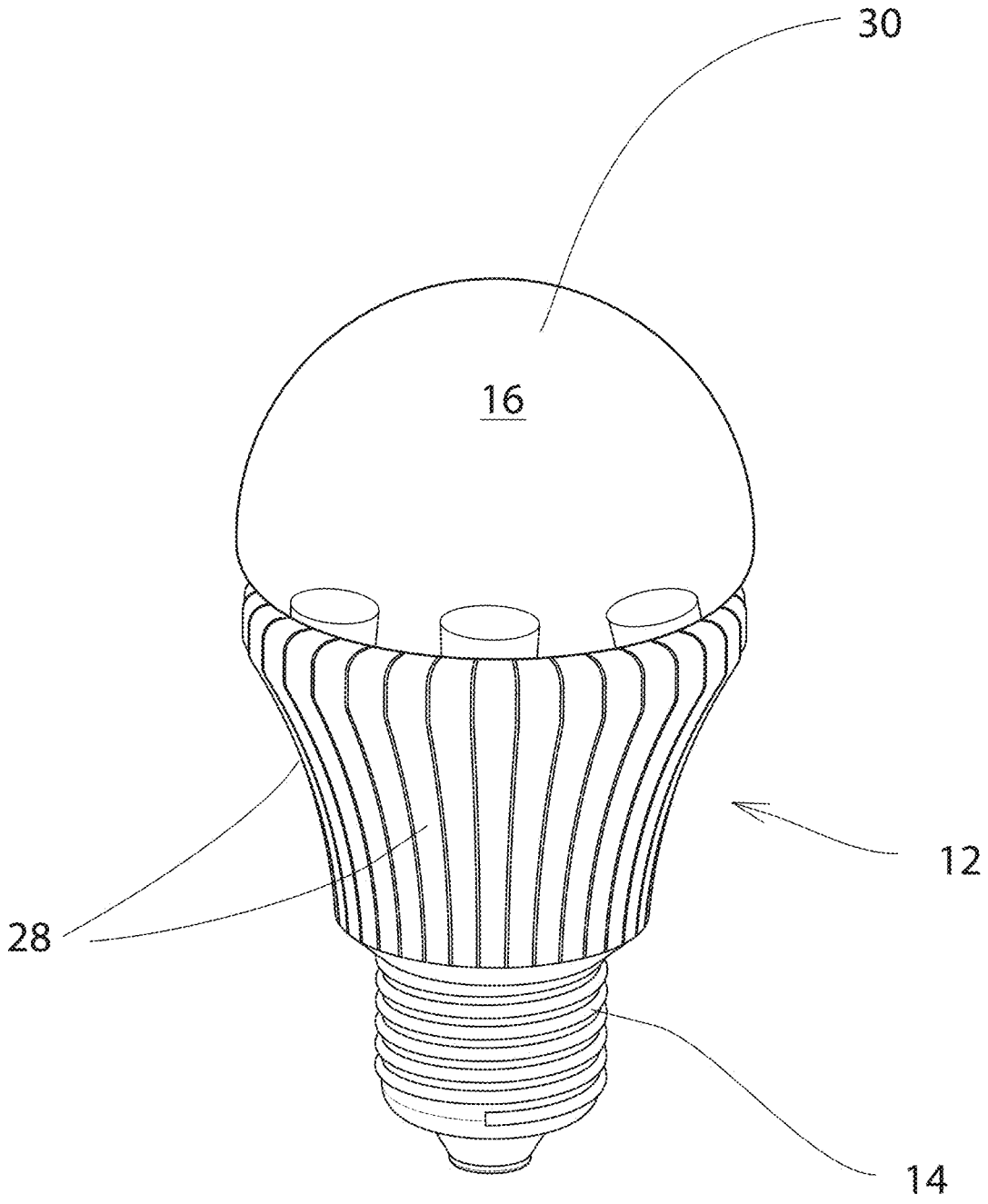
FIG. 2 is a perspective of a bulb incorporating the necessary circuitry.
Figure 3:
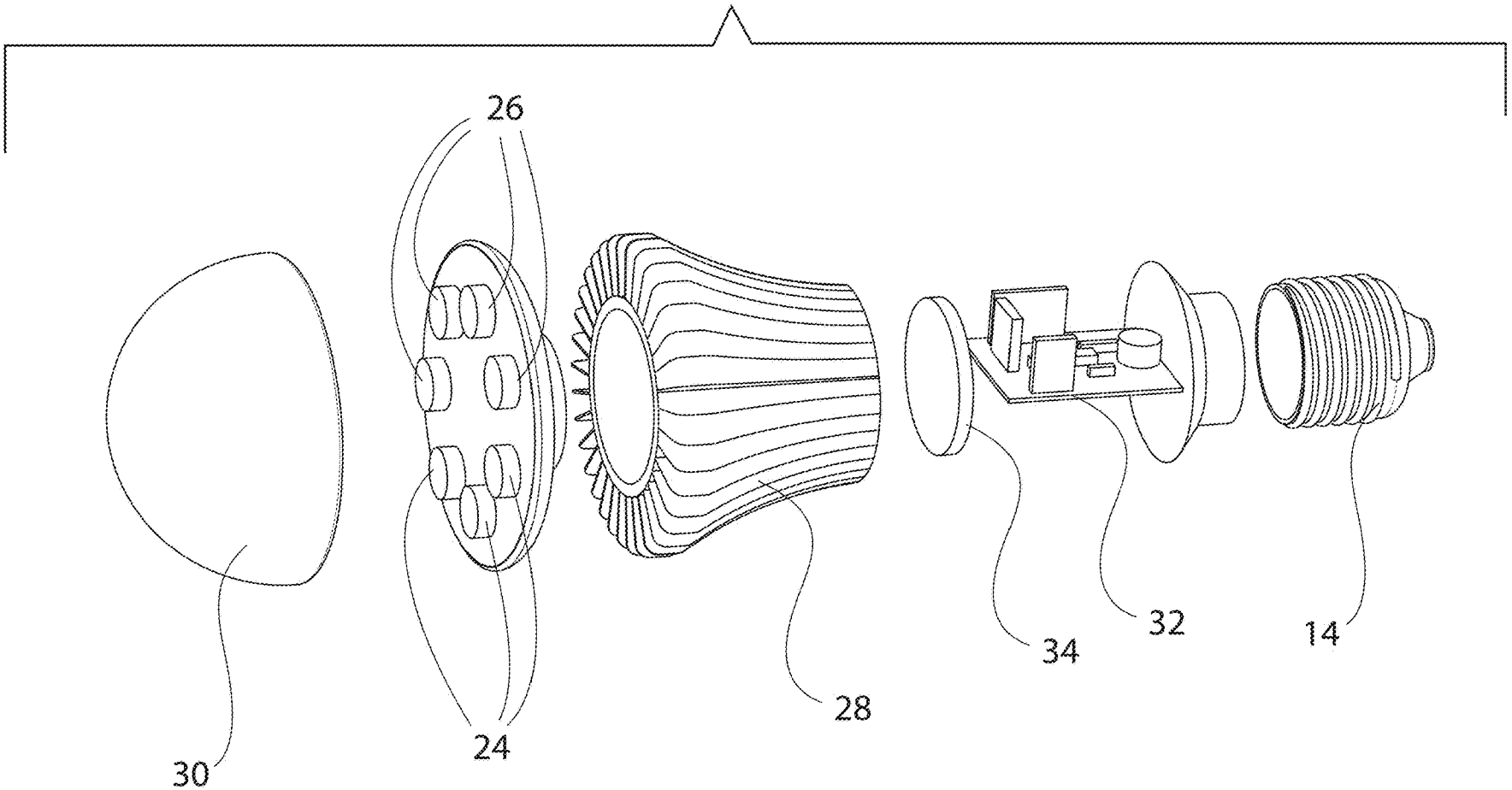
FIG. 3 is an exploded perspective of the bulb and base.
Figure 4:
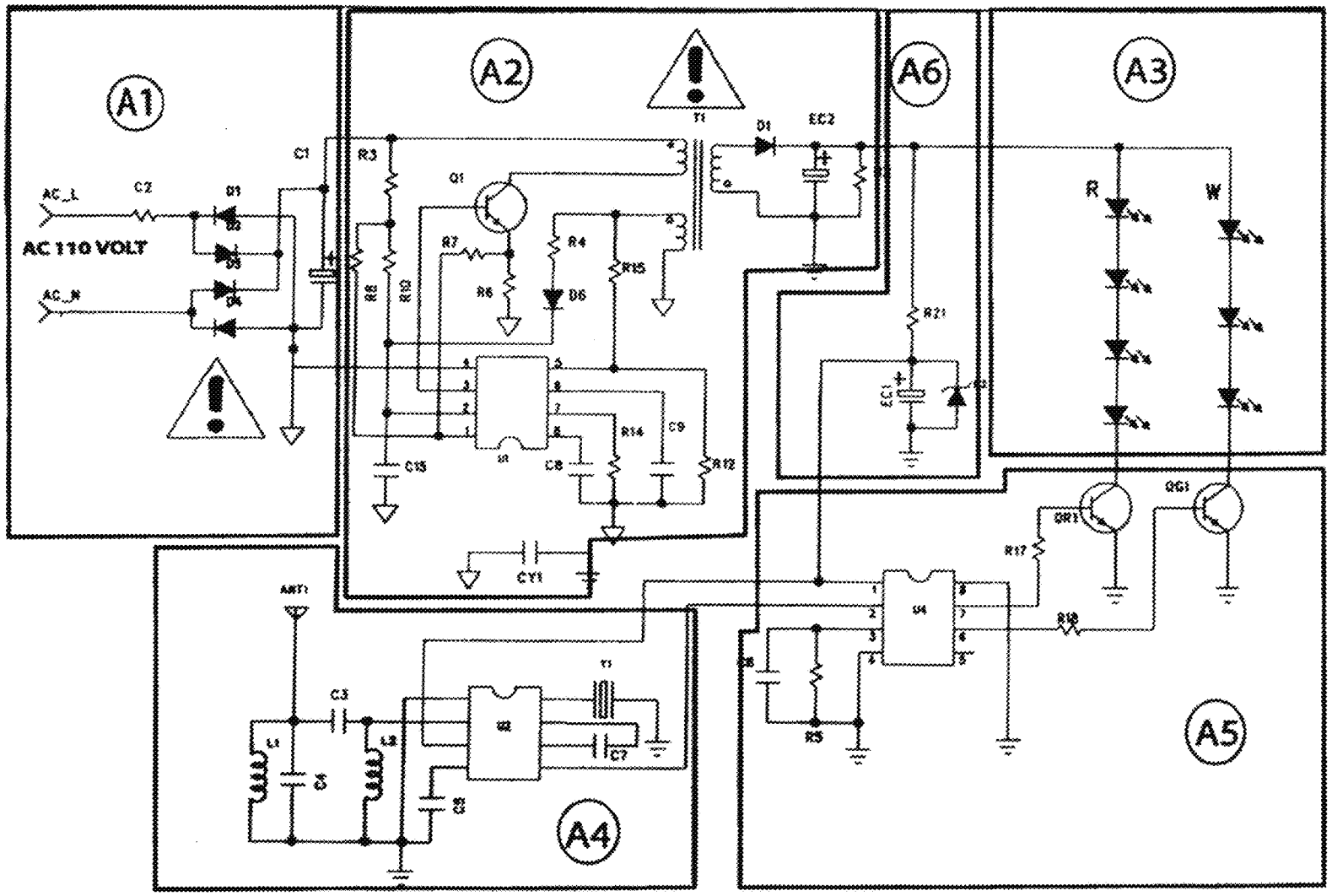
FIG. 4 is a circuit diagram showing the various components of the bulb circuitry.

In order to achieve the objective of the invention, a special alert light bulb (12) is provided (FIG. 3), having an extended base portion (14), and an illumination portion (16) containing special lighting elements (18) for various lighting effects.

The lighting effects may be simply a flashing white light, or may be alternating red and white lights or the like.

In addition to the various different lighting effects for flashing lights, the lighting elements are capable of providing a steady white light, if the resident in the home simply wishes to illuminate the front porch at night, in the normal way or when expecting a visitor.

In order for a resident to activate the alert light bulb (12), a suitable remote control (20) is provided. The remote (20) will typically be fitted with a cord which can be worn around the neck.

However other forms of remote are possible, including wrist operation, ora waist band (not shown).

The remote (20) will contain suitable radio frequency circuits such as are well known in the art. Such radio frequency circuits will have a range suitable for transmission throughout the residence, and will be of sufficient strength to reach the control circuits in the bulb itself. The alert bulb (12) as explained above has suitable circuitry incorporated in the bulb base (14), to carry out three functions.

The first function is of course to receive the domestic voltage of alternating current and convert it to a suitable low voltage, typically around 5 volts, and direct current, so that it is suitable for processing through miniaturized circuits and powering LED lighting elements (18).

The second function is to activate the circuitry in the bulb base (14) responsive to radio frequency signals from the remote, so as to power the LED elements (18) in the bulb (12), and provide a flashing signal.

The third function, as suggested above, would be to provide a simple steady white light for normal illumination of the front porch of the residence. This, of course, would not be an emergency or alert signal, but would simply provide the illumination for possible guests or visitors to the residence.

It will be appreciated that the elements in the bulb (12) are low voltage, eg. LED units (18) which provide light from low voltage sources. In this case, there are three LEDs (24) which provide white light and four LEDs (26) which provide red light. In this way it is possible to arrange that when it is in use, the alert light will flash alternately red and white, thus providing a distinctive and unique guidance identification for recognition by responders.

A heat sink (28) is provided and a dome (30) covers the LED's (24, 26).

Figure 5:
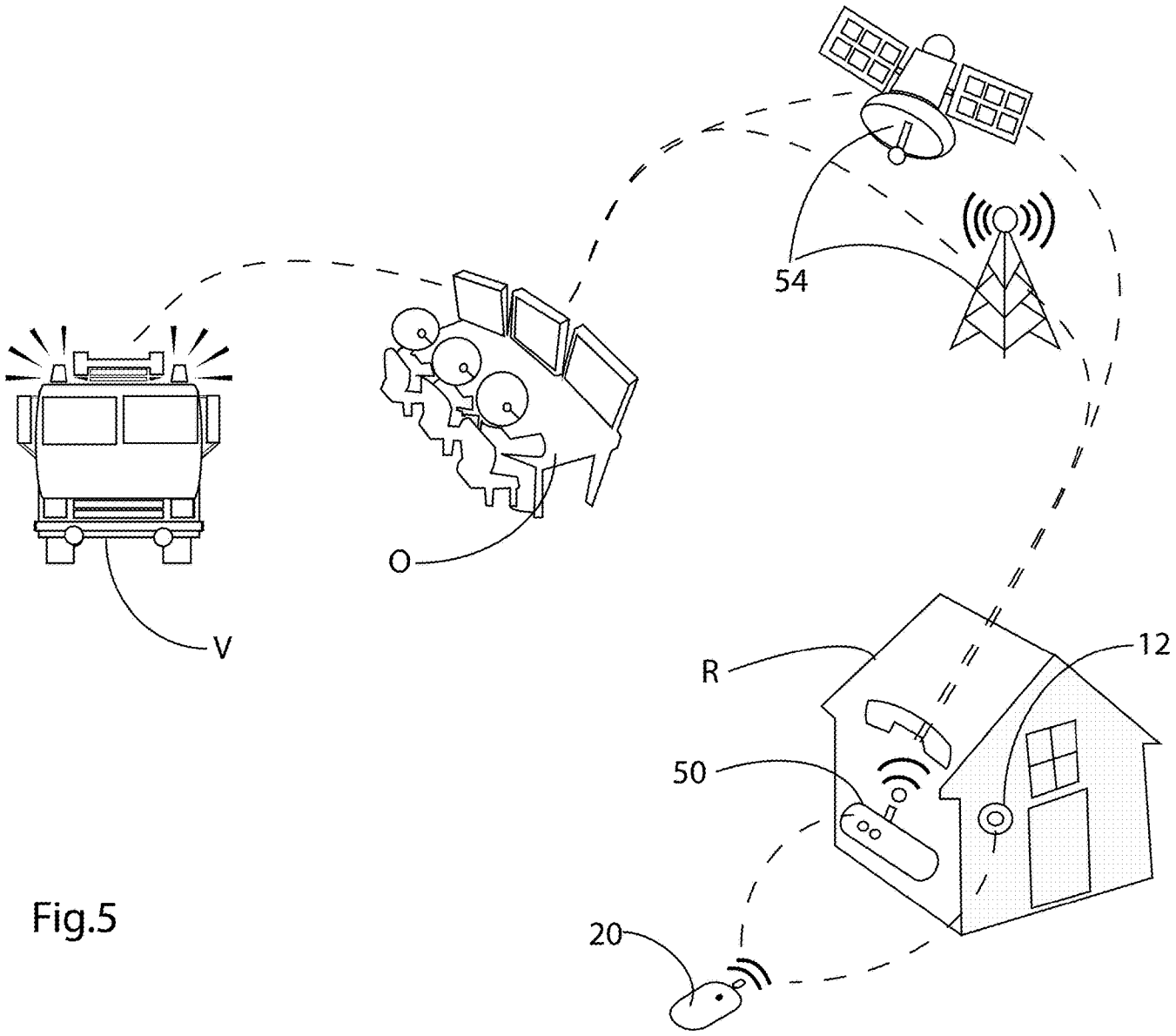
FIG. 5 is a schematic perspective illustration of a use of the system with a GPS satellite, or with cellular signalling towers.

In order to achieve this, the circuits will be seen to comprise (FIG. 5)

A1, a power supply,

A2, an isolating power supply which converts high voltage AC to low voltage DC current and power the LED lights.

A3 shows the LED lights.

A4 is the radio frequency receiver. These components have an antenna and receive signals from the remote, when it is activated.

A6 is a voltage regulator supplying DC power to the receiver.

A5 is a logic switch which controls the switches, for activating the red and/or white LEDs.

All of these circuit components are mounted on a miniature circuit board (32) contained within the bulb base (14).

Within the base (14) a siren sound generator (34) may also be provided. Siren (34) is connected to circuit board (32) and suitable switches, on the board.

The bulb base (14) is, as explained above, provided with a typical screw base fitting, such as is well known in the art, to be screwed into a conventional household electrical lighting socket in North America. Other bases such as pin types may be provided for various other designs of sockets.

The remote will require a battery pack to power the radio frequency signals in the event that they are required. The provision of such a remote with a battery pack is well known in the art and requires no special description.

Similar circuits can be provided for incorporation in a telephone alarm system. Such a telephone alarm system will typically incorporate a master unit (50), which is connected to the land line. The master unit (50) will typically incorporate a wireless receiver, for receiving signals from the wireless remote, and may also incorporate a voice system including a microphone, and a speaker (not shown) so that a person may carry on a conversation without actually lifting up a telephone unit. The master unit will be connected simply by a conventional telephone jack (not shown), and will be powered by the usual domestic power supply.

Thus, when remote (20) is activated, the master unit (50) will send a telephone signal to the responder office and the remote also activates the alert bulb (12).

The system can also connect via a cell phone. Such a cell phone connection can be in addition to the bulb and siren. It will provide direct voice connection between the distressed person and a responder.

The system can also be used in conjunction with GPS satellites (54). The master unit (50) would be provided with a transmitter to transmit signals to a satellite. This satellite would in turn retransmit those signals directly to a responder office (O). The responder office could then immediately send GPS location instructions to the responder vehicle (V) which might already be on the road. This will further speed up the arrival of the responder, at the desired location.

Figure 6:
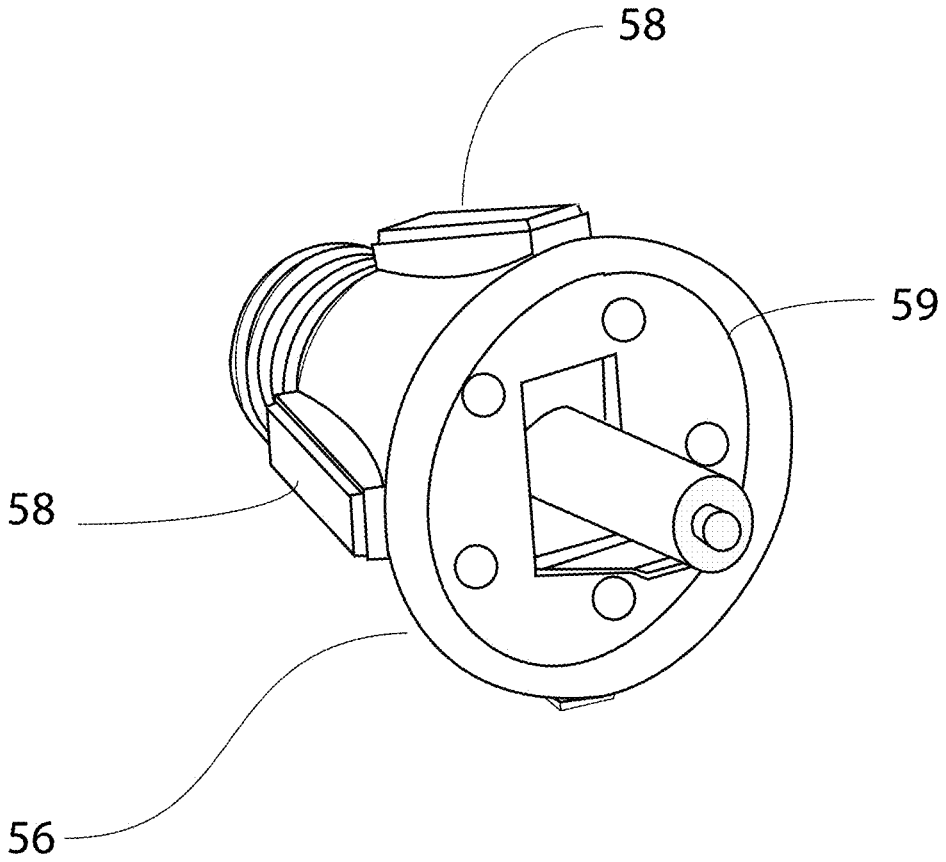
FIG. 6 is a perspective illustration showing a form of alert light incorporating a battery, and solar panels.
Figure 7:
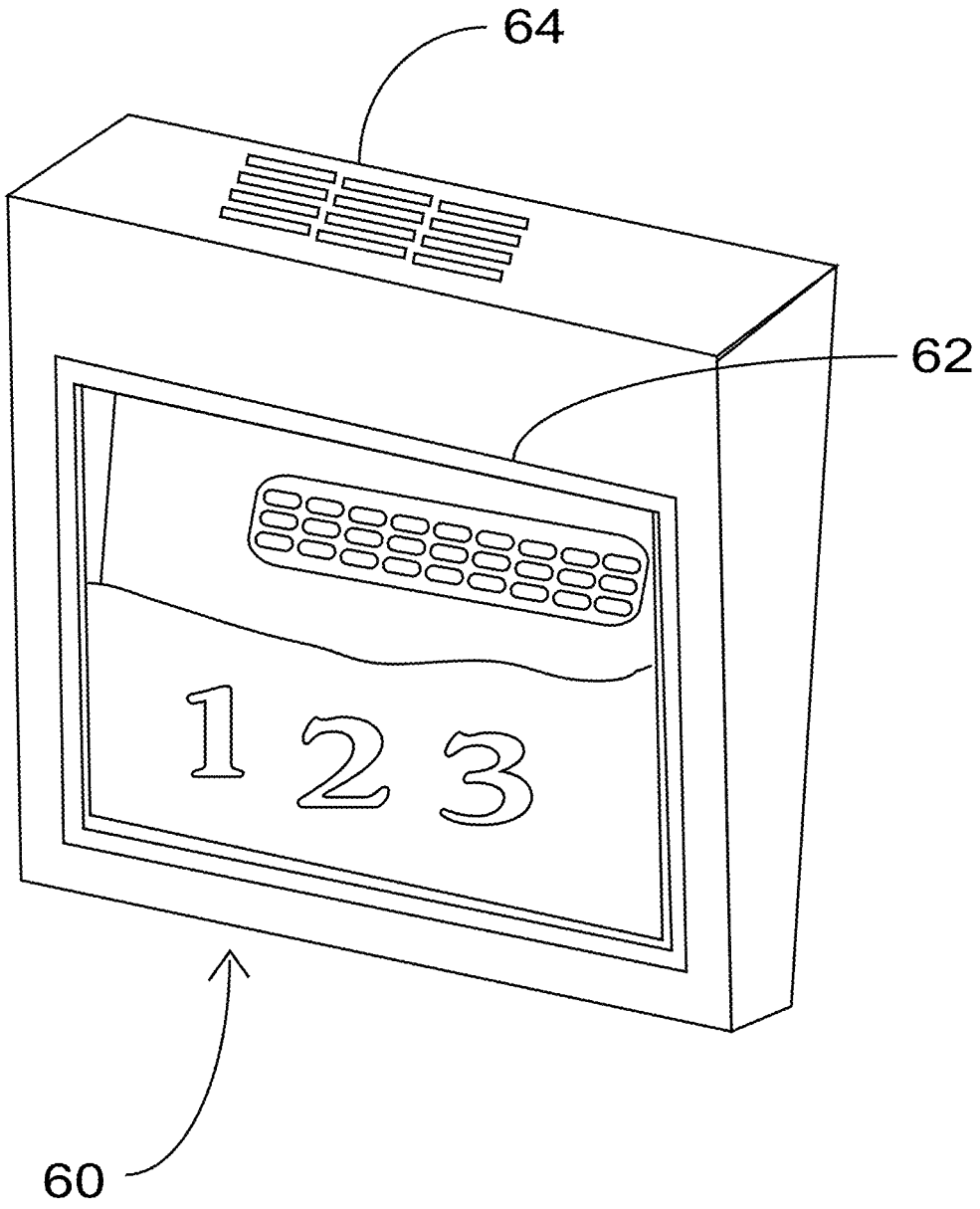
FIG. 7 is a perspective illustration of a typical house street number sign, incorporating an illuminated street number panel, and flashing LED lights.

In some cases a porch light (56) FIG. 6 may be operated by solar panels (58) charging a suitable battery (not shown).

In some cases, houses are provided with illuminated house street number signs (60). In these cases, the house number sign can be modified so as to incorporate LED illumination (62), and may be powered by the domestic power or by solar power through solar panel (64). Thus when activated by the wireless remote (20), the house number can then be illuminated by the flashing LED lights, which may for example change colour.

In a more advanced case, it may be possible for the LED lights to provide a word such as the word help HELP in place of the house number.

Figure 8:
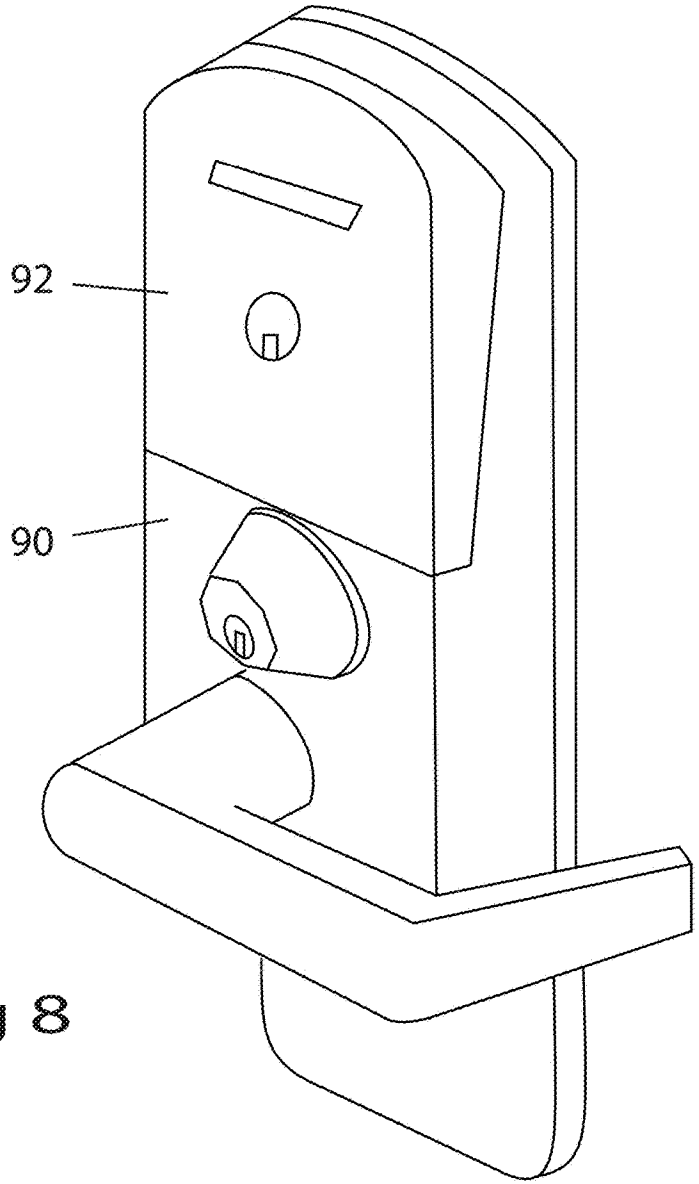

A siren (82) is also installed in the bulb base to generate a sound effect at the time of emergency. When the alert light is activated and starts blinking, the siren will start as well. A further option is shown in FIG. 8. In this case there is provided a personally installable remotely operable door lock (90) for the residence. The lock (90) has a wireless responsive lock operator (92), operable in response to activation of the remote to open the door lock and admit aid responders to the residence. A modified remote (94) is provided in the case having an additional button for operating the door lock.

There may be some householders where there is a porch light, on the front porch of the house, and an interior switch, by means of which the porch light can be switched on or off. In order to ensure that the alarm system of the invention is available 24 hours a day 7 days a week, the porch light switch should always be left on (FIGS. 9 and 10).

It may also be possible to connect a smoke detector (FIG. 11), to the master unit. In this way, by wireless circuits, if there is a smoke problem detected, an alarm can be sent, automatically. This can operate even if no one is present in the house.

As and when responders arrive a switch enables the alert system to be switched off.

As explained above, it is desirable for the smoke detector (FIG. 11) to be provided with a wireless communication module (96). This module will be provided in each smoke detector at each location in a residence (FIG. 12). In this way, activation of a smoke detector in one room of the residence will automatically activate all of the smoke detectors in the residence so that they alert the resident who may be located in a different room of the residence.

This wireless communication between the smoke detectors, will also be advantageously coupled with the alert system in the residence. Thus if there is activation of a smoke detector in the residence, and, for example, if the resident is not there, or if the home is unoccupied, then the smoke detector will connect via the wireless module, to the alert system described above. This will then send alarm signals to the responder office, through the master unit. The master responder office can then send appropriate responders to the residence.

The system may also use a conventional key safe (not shown), well known in the art, on the exterior of the residence. This will enable responders to access the residence, even when the resident is absent.

According to the further embodiment of the invention (FIGS. 13 and 14), the circuits may provide for using the alert light (100) as a steady porch light. In this case, it is also desirable that the alert light shall incorporate a photo electric light sensor (102), and that the circuits for controlling the system may incorporate separate power supplies to the LED white lights in the alert light. Such a modified circuit (FIG. 13) will incorporate all of the features described in connection with the previous circuit diagram, with the addition of the photo electric control section (104) shown in FIG. 13. In this way, it is possible for the alert light to simply function as a porch light which comes on at dusk and switches off at sunrise. This function will continue even though the resident continues living safely in the residence and does not have a personal incident, and also that the is no smoke detector alarm.

In this alternate embodiment, the circuits will be seen from FIG. 13) to comprise B1—a power supply;

B2—an insulating power supply, which converts high voltage AC to low voltage DC and power the LED lights;

B3 shows the white LED lights;

B4 shows the red LED lights;

B5 is a radio frequency receiver. These components have an antenna and receive signals from the remote when it is activated.

B6 is a voltage regulator supplying DC power to the receiver.

B7 is a logic switch which controls the switches for activating the red and/or white LEDs, and incorporates the controller for receiving ambient light signals from the photo electric sensor in the bulb.

All of these circuit components are attached on a miniature circuit board and are located and contained within a bulb base.

With the present embodiment of the bulb incorporating it's own ambient sensor and micro controller, connected to the white LEDs, it is possible for the bulb to function simply as a normal porch light without any alarm signal, so long as there is no alarm being signalled from inside the residence. The white LED lights will simply come on dusk and go off in the morning, and this function is contained entirely within the bulb itself.

It is only when the resident has an incident, or there is a smoke or flood alarm, for example, then the bulb will be signalled to flash the red lights and also flash the white lights alternately. This will then signal responders, of whatever kind, to the correct house without delay.

In the event of the smoke alarm, the improved smoke detector system will provide for wireless communication between all smoke detectors within the residence. In this way if a smoke detector is activated anywhere in the residence, it will signal by wireless, to all the other smoke detectors in different locations of the building so that they all provide a warning signal to persons within the building. Since the smoke detectors are connected to the base control, the signal of the smoke alarm will then be transmitted to the alert light even where there is no one present in the residence. The responders will then get the message that there is a smoke problem, and find the residence quickly and easily, and deal with the problem.

It may also be desirable to for some form of warning to neighbouring residences. This warning system would, of course, be dependant upon the willingness of the owner of the neighbouring residences to be connected. However, that may be a desirable feature in a neighbourhood where persons in neighbouring residences would wish to be informed. Such a connection is shown in FIG. 12, referred to above.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. An alert system, adapted to be located on the exterior of a residence in a conventional domestic exterior light receptacle and operable to alert aid responders and to guide the aid responders to the residence and comprising;

an alert bulb having a globe portion;

a plurality of low voltage white response lights in said globe portion;

a bulb base portion attached to the globe portion and installable in said conventional domestic light receptacle;

steady light wireless response circuits contained in said bulb base portion and operable to supply constant low voltage power to said low voltage white response lights to activate said response lights upon receipt of a wireless signal from a remote within the residence to create the impression of constant white porch light on said residence;

flashing light wireless response circuits-contained in said bulb base portion and operable to supply intermittent power to said low voltage white lights whereby to generate flashing light;

a radio frequency remote activator within the residence and operable in the event of an alarm within the residence to communicate from within the residence with said response circuits in said bulb base portion on the exterior of the residence and activate said low voltage response lights in said alert bulb on the exterior of said residence whereby to establish flashing light alert lights in said alert bulb to direct aid responders to said residence.

2. The alert system as claimed in claim 1 including a smoke detector in the residence;

a wireless response circuit in the smoke detector, operable to activate the alert bulb system, enabling responders to respond to a smoke incident in the residence and wherein there are a plurality of smoke detectors at various locations in the residence, and including smoke detector wireless response circuits in each said smoke detector, each of said smoke detector wireless response circuits being operable when the smoke detector in one location is activated, whereby the smoke alarm will be communicated throughout said residence in all of said smoke detectors to alert persons in the residence.

3. The alert system as claimed in claim 2 and including an ambient light detector on said alert bulb, said ambient light detector being connected to said circuits in said bulb base, and operable to activate said low voltage response lights in said bulb to provide steady illumination around said residence.

4. An alert system, adapted to be located on the exterior of a residence in a conventional domestic exterior light receptacle and operable to alert aid responders and to guide the aid responders to the residence and comprising;

an alert bulb having a globe portion;

a plurality of low voltage white response lights in said globe portion;

a plurality of low voltage colored response lights in said globe portion;

a bulb base portion attached to the globe and installable in said conventional domestic light receptacle;

wireless response circuits contained in said bulb base portion and operable to supply low voltage power to said low voltage response lights to activate said response lights upon receipt of a wireless signal from a remote within the residence wherein said response circuits include controls operable to supply constant power to said low voltage white low voltage response lights whereby to generate continuous light during desired time frames, to create an impression of constant white porch light on said residence;

a radio frequency remote activator within the residence and operable in the event of an alarm within the residence to communicate from within the residence with said response circuits in said bulb base portion on the exterior of the residence and activate said both white and colored said low voltage response lights in said alert bulb on the exterior of said residence whereby to establish alternate white and red flashing alert lights in said alert bulb to direct aid responders to said residence.

5. The alert system, adapted to be located on the exterior of a residence in a conventional domestic exterior light receptacle and operable to alert aid responders and to guide the aid responders to the residence as claimed in claim 4 including an ambient light detector on said alert bulb, said ambient light detector being connected to said circuits in said bulb base, and operable to activate said low voltage white response lights in said bulb to provide steady illumination around said residence.

* * * * *